US008672707B2

(12) United States Patent
Nichols et al.

(10) Patent No.: US 8,672,707 B2
(45) Date of Patent: Mar. 18, 2014

(54) CONNECTOR ASSEMBLY CONFIGURED TO ALIGN COMMUNICATION CONNECTORS DURING A MATING OPERATION

(75) Inventors: Robert Paul Nichols, Vacaville, CA (US); Neil Franklin Schroll, Mound Joy, PA (US); Alex M Sharf, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 22 days.

(21) Appl. No.: 13/402,402

(22) Filed: Feb. 22, 2012

(65) Prior Publication Data

US 2013/0217260 A1 Aug. 22, 2013

(51) Int. Cl.
*H01R 12/24* (2006.01)

(52) U.S. Cl.
USPC ..... 439/493

(58) Field of Classification Search
USPC ..... 439/493, 497, 248, 247, 502, 660, 638, 439/573
See application file for complete search history.

(56) References Cited

U.S. PATENT DOCUMENTS

| | | | | |
|---|---|---|---|---|
| 4,776,664 | A * | 10/1988 | Okura | 385/101 |
| 5,203,720 | A * | 4/1993 | Zini | 439/502 |
| 5,507,668 | A * | 4/1996 | Lambrinos et al. | 439/502 |
| D422,968 | S * | 4/2000 | Tsai et al. | D13/147 |
| 6,095,825 | A * | 8/2000 | Liao | 439/76.1 |
| 6,411,506 | B1 | 6/2002 | Hipp et al. | |
| D473,848 | S * | 4/2003 | Zheng et al. | D13/147 |
| 6,785,133 | B2 | 8/2004 | Barringer et al. | |
| 6,830,478 | B1 * | 12/2004 | Ko | 439/579 |
| 7,042,737 | B1 | 5/2006 | Woolsey et al. | |
| D525,199 | S * | 7/2006 | Lin | D13/133 |
| 7,079,381 | B2 | 7/2006 | Brehm et al. | |
| 7,097,495 | B2 | 8/2006 | Sweetland | |
| 7,220,146 | B2 * | 5/2007 | Miyazaki | 439/579 |
| 7,377,803 | B2 * | 5/2008 | Matsuoka | 439/497 |
| 7,892,001 | B2 * | 2/2011 | Hanyu | 439/247 |
| 8,137,128 | B2 * | 3/2012 | Hsueh et al. | 439/499 |
| 2008/0019100 | A1 | 1/2008 | Yang | |
| 2008/0057764 | A1 | 3/2008 | Kuo | |

FOREIGN PATENT DOCUMENTS

| | | | |
|---|---|---|---|
| CH | 702790 | A2 | 9/2011 |
| WO | 2004051809 | A2 | 6/2004 |

OTHER PUBLICATIONS

International Search Report dated Apr. 2, 2013 received for related PCT Patent Application No. PCT/US2013/023705.
High Speed Backplane Interconnect Solutions 2007, 6 pages.
Z- PACK TinMan Connector System Aug. 2010, 38 pages.

* cited by examiner

*Primary Examiner* — Alexander Gilman

(57) ABSTRACT

A connector assembly including an assembly housing having a leading end, a back end, and an interior cavity extending therebetween. The interior cavity opens to the leading end. The connector assembly also includes a communication connector that is disposed in the interior cavity proximate to the leading end and movably held therein. The connector assembly also includes a board connector located a distance away from the communication connector. The connector assembly also includes a flexible cable assembly that has communication cables extending between and communicatively coupling the board connector and the communication connector. The communication connector is configured to engage a mating connector when the communication connector and the mating connector are mated along a mating axis. The communication connector and the cables are permitted to float relative to the assembly housing when the communication connector mates with the mating connector.

17 Claims, 7 Drawing Sheets

CONNECTOR ASSEMBLY CONFIGURED TO ALIGN COMMUNICATION CONNECTORS DURING A MATING OPERATION

BACKGROUND OF THE INVENTION

The subject matter described and/or illustrated herein relates generally to connector assemblies having a communication connector that is configured to align with and engage another connector during a mating operation.

Some communication systems, such as a blade server system, include a large backplane (or midplane) circuit board, which is generally referred to as a backplane (or midplane). The system also includes a plurality of communication devices (e.g., switch modules) that are coupled to a front side of the backplane, and a plurality of communication devices that are coupled to a back side of the backplane. The devices coupled to the front side extend parallel to each other, but orthogonal to the devices coupled to the back side of the backplane. For example, the devices along the front side may extend vertically, and the devices along the back side may extend horizontally. The front side devices and the back side devices are communicatively coupled to one another through the backplane.

The front side and/or back side devices typically include a module card (e.g., a circuit board) with a number of connector assemblies mounted to a leading edge of the module card. The devices are configured to be inserted into a system chassis where the connector assemblies are coupled to mating connectors of the backplane during a mating operation. However, as the number of connector assemblies along the leading edge increases, it may become more challenging to align each of the connector assemblies with a corresponding mating connector due to tolerances in the manufacturing of the module cards, the connector assemblies, the mating connectors, the system chassis, or other components of the system.

The challenge can be even greater in blade server systems where there is no backplane or midplane circuit board and the devices are directly engaged to each other. For instance, each device that extends vertically can be directly coupled to several devices that extend horizontally, and each device that extends horizontally can be directly coupled to several devices that extend vertically.

Accordingly, there is a need for connector assemblies that are capable of tolerating misalignment between two communication connectors during a mating operation.

BRIEF DESCRIPTION OF THE INVENTION

In one embodiment, a communication connector assembly is provided that includes an assembly housing having a leading end, a back end, and an interior cavity extending therebetween. The interior cavity opens to the leading end. The connector assembly also includes a communication connector that is disposed in the interior cavity proximate to the leading end and movably held therein. The connector assembly also includes a board connector that is configured to be mounted to a circuit board and located a distance away from the communication connector. The connector assembly also includes a flexible cable assembly that has communication cables extending between and communicatively coupling the board connector and the communication connector. The cables extend through the interior cavity. The communication connector is configured to engage a mating connector when the communication connector and the mating connector are mated along a mating axis. The communication connector and the flexible cable assembly are permitted to float relative to the assembly housing when the communication connector mates with the mating connector.

In another embodiment, a communication device is provided that includes a device housing having leading and trailing sides. The device housing includes a support structure that is located proximate to the leading side. The communication device also includes a connector assembly that is held by the device housing. The connector assembly includes a first communication connector movably coupled to the support structure and positioned proximate to the leading side. The connector assembly also includes a second communication connector that is located in the device housing a distance away from the first communication connector. The connector assembly also includes a flexible cable assembly having communication cables that extend between and communicatively couple the first and second communication connectors. The first communication connector is configured to engage a mating connector when the first communication connector and the mating connector are mated along a mating axis. The first communication connector and the flexible cable assembly are permitted to float relative to the support structure when the first communication connector mates with the mating connector.

In yet another embodiment, a connector assembly is provided that includes a board connector having mounting and loading sides that face in generally opposite directions. The mounting side is configured to be mounted to a circuit board. The connector assembly also includes communication cables that are coupled to the board connector along the loading side and a seating member that is coupled to the loading side. The seating member includes a member body having a plurality of cable cavities that receive the cables. The cables extend through the cable cavities and exit the seating member. The seating member protects the cables during a mounting operation when the seating member is pressed against the board connector toward the circuit board.

DETAILED DESCRIPTION OF THE INVENTION

Figure 1:
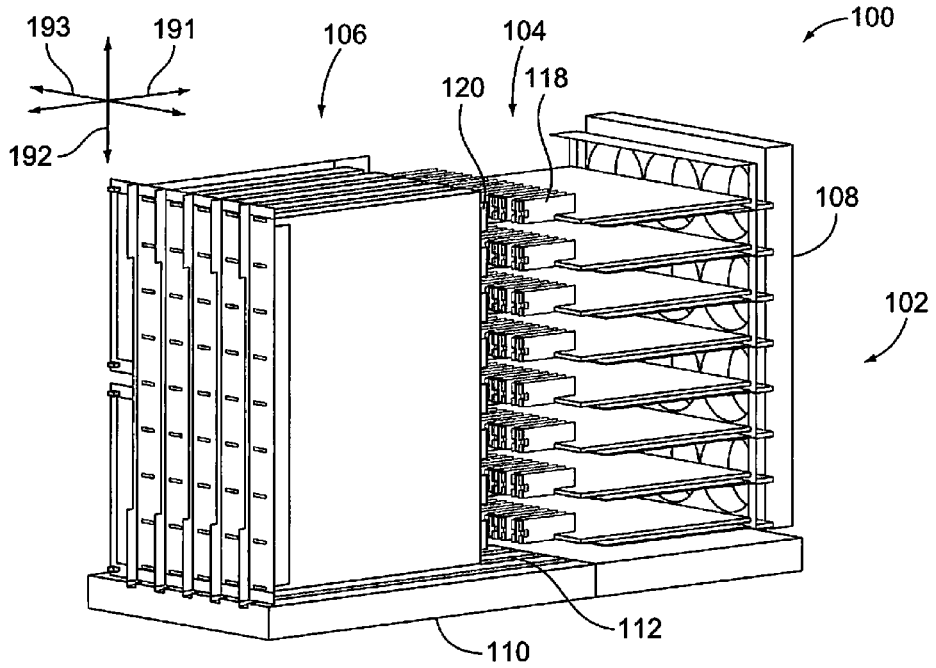
FIG. 1 is a perspective view of a communication system having a plurality of communication devices formed in accordance with one embodiment.

FIG. 1 is a perspective view of a communication system 100 formed in accordance with one embodiment. The communication system 100 includes a system chassis 102 and first and second communication devices or modules 104, 106. The first and second communication devices 104, 106 have respective connector assemblies 118, 120 that are configured to communicatively couple to one another during a mating operation. For example, the connector assemblies 118, 120 may directly couple to one another in a pluggable manner during the mating operation. In particular embodiments, the system 100 is a blade server system in which some or all of the communication devices 104, 106 are readily separable from the system 100. In some embodiments, the first communication devices 104 may be referred to as server modules and the second communication devices 106 may be referred to as switch modules. Although the system 100 is a blade server system in an exemplary embodiment, the system 100 and the connector assemblies 118, 120 may be used in other applications.

The system 100 is oriented with respect to mutually perpendicular axes 191-193, including a mating axis 191, an orientation (or vertical) axis 192, and another orientation (or horizontal) axis 193. As shown, each of the communication devices 104 extend along a plane that is parallel to the mating and orientation axes 191, 193, and each of the communication devices 106 extend along a plane that is parallel to the mating and orientation axes 191, 192. As such, the communication devices 104, 106 (and the corresponding connector assemblies 118, 120) may be characterized as having an orthogonal mating relationship. For example, each of the communication devices 104 in FIG. 1 is oriented orthogonal to each of the communication devices 106, and vice versa. With the orthogonal relationship, each of the communication devices 104 can be communicatively coupled to a plurality of the communication devices 106, and each of the communication devices 106 can be communicatively coupled to a plurality of the communication devices 104.

In the illustrated embodiment, the system chassis 102 holds the first communication devices 104 in fixed positions along a back wall 108. (For illustrative purposes, only a portion of the system chassis 102 is shown.) The system chassis 102 may also be configured to receive and hold the communication devices 106. For example, the system chassis 102 may include a base wall 110 that includes slots or guide rails 112. Each of the slots 112 may be shaped to receive an edge of the communication device 106 and direct the communication device 106 toward the communication devices 104. In an exemplary embodiment, the first and second communication devices 104, 106 directly couple to one another through the corresponding connector assemblies 118, 120 as shown in FIG. 1.

However, in alternative embodiments, the system 100 may include a backplane or midplane circuit board between the communication devices 104, 106. In such alternative embodiments, the communication devices 104, 106 may directly couple to opposite sides of the backplane circuit board. The backplane circuit board may include conductive pathways (e.g., traces) that communicatively couple the communication devices 104, 106 in a predetermined manner. Although not shown in FIG. 1, the system 100 may include additional devices, such as cooling fans and a power supply.

Figure 2:
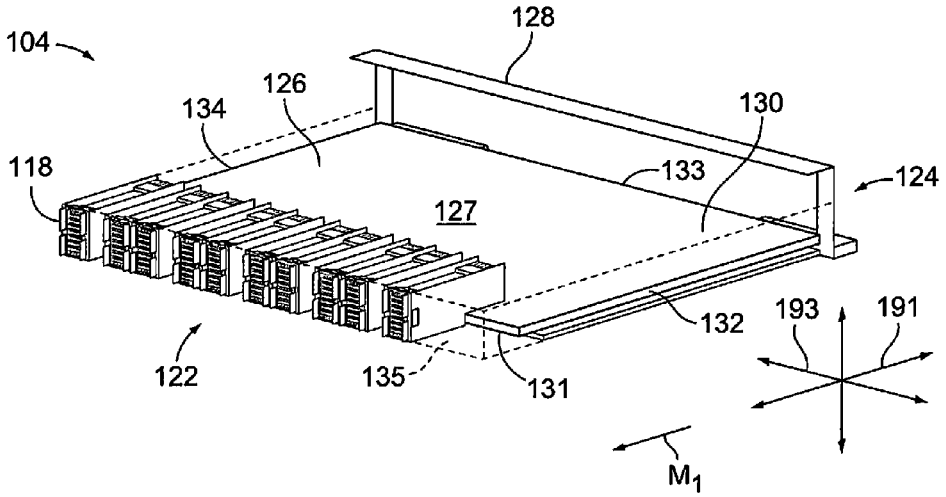
FIG. 2 is a perspective view of one of the communication devices that may be used with the system of FIG. 1.

FIG. 2 is a perspective view of the communication device 104. Although not shown, the communication device 106 (FIG. 1) may have similar features as the communication device 104. In an exemplary embodiment, the communication device 104 has a leading or mating side 122 and a trailing or rear side 124. When the communication device 104 is held by the system chassis 102 (FIG. 1), the leading side 122 faces in a mating direction $M_1$ along the mating axis 191. As shown, the communication device 104 may include a plurality of the connector assemblies 118, a circuit board 126 having a board surface 127, and a module frame 128. The connector assemblies 118 face in the mating direction $M_1$ and are arranged side-by-side in a direction along the orientation axis 193.

The circuit board 126 extends between the leading and trailing sides 122, 124 of the communication device 104. The module frame 128 is secured to the circuit board 126 and may provide structural support to the circuit board 126. The module frame 128 may be sized and shaped to be gripped by an individual or machine for assembling the system 100 (FIG. 1). Optionally, the module frame 128 may constitute or be part of a device housing 130 (indicated in phantom) of the communication device 104 that is secured to the circuit board 126. For instance, the device housing 130 may include the module frame 128 and also a support structure 135 (e.g., a wall of the device housing 130) that is located proximate to and along the leading side 122. The device housing 130 may include the leading and trailing sides 122, 124 of the communication device 104. The support structure 135 can interface with the communication devices 106 in the system 100. The support structure 135 can be coupled to leading ends of the connector assemblies 118.

As shown, the circuit board 126 is defined by a plurality of board edges 131-134, including a mating edge 131. The mating edge 131 extends proximate to and along the leading side 122. As shown, the connector assemblies 118 may be mounted onto the board surface 127 proximate to the leading side 122. For example, in the illustrated embodiment, the leading ends of the connector assemblies 118 extend beyond the mating edge 131 in the mating direction $M_1$. As another example, the ends of the connector assemblies 118 may extend to and be substantially flush with the mating edge 131 or may be located a depth in from the mating edge 131.

Although not shown, the communication device 104 may include additional components other than the connector assemblies 118, the circuit board 126, and the device housing 130. For example, the communication device 104 may include input/output (I/O) components, processors (e.g., ASICs), or additional communication connectors that are mounted to the circuit board 126. Other components can be heat sinks.

Figure 3:
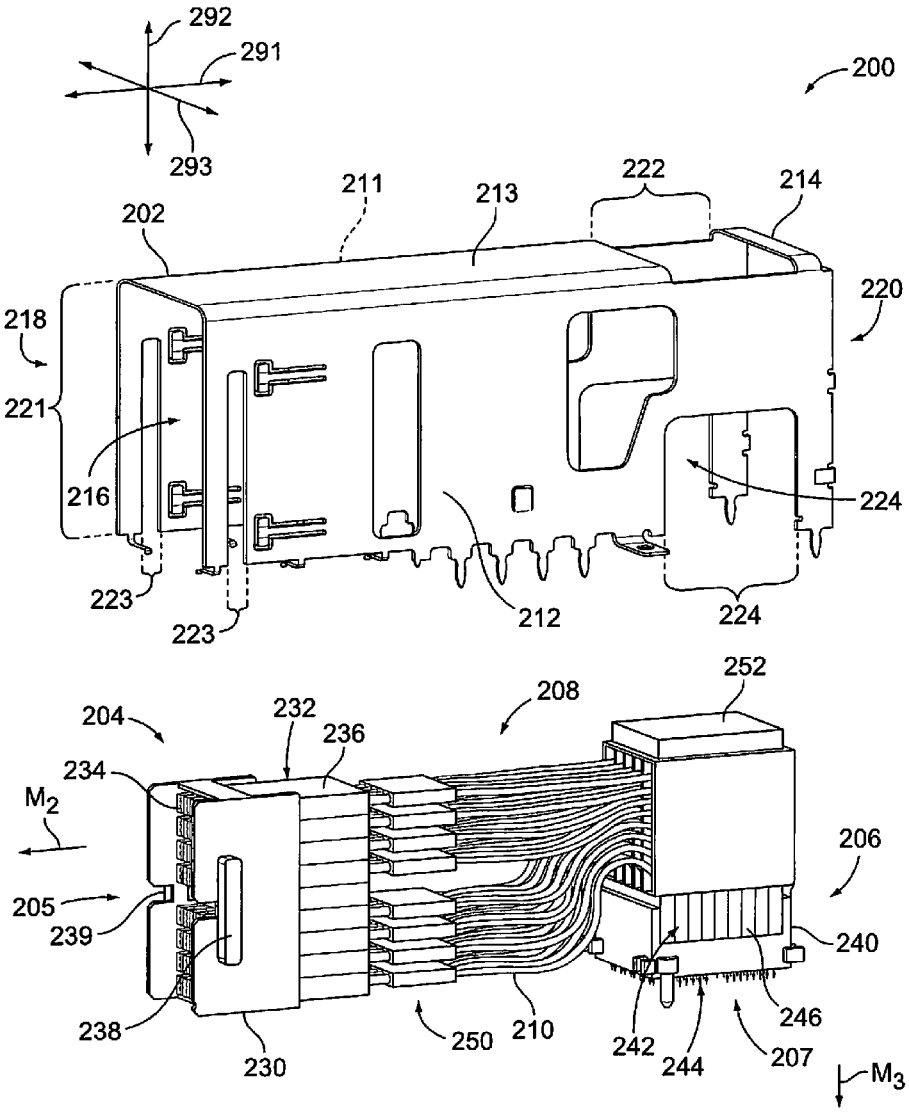
FIG. 3 is a partially exploded view of a connector assembly formed in accordance with one embodiment that may be used with the communication device(s) of FIG. 1.

FIG. 3 is a partially exploded view of a connector assembly 200 formed in accordance with one embodiment. The connector assembly 200 is oriented with respect to mutually perpendicular axes 291-293, including a mating axis 291 and orientation axes 292, 293. The connector assembly 200 may be used as either of the connector assemblies 118, 120 (FIG. 1) in the system 100 (FIG. 1). However, the connector assembly 200 is not required to be part of a blade server system, but may be used in other applications.

Figure 5:
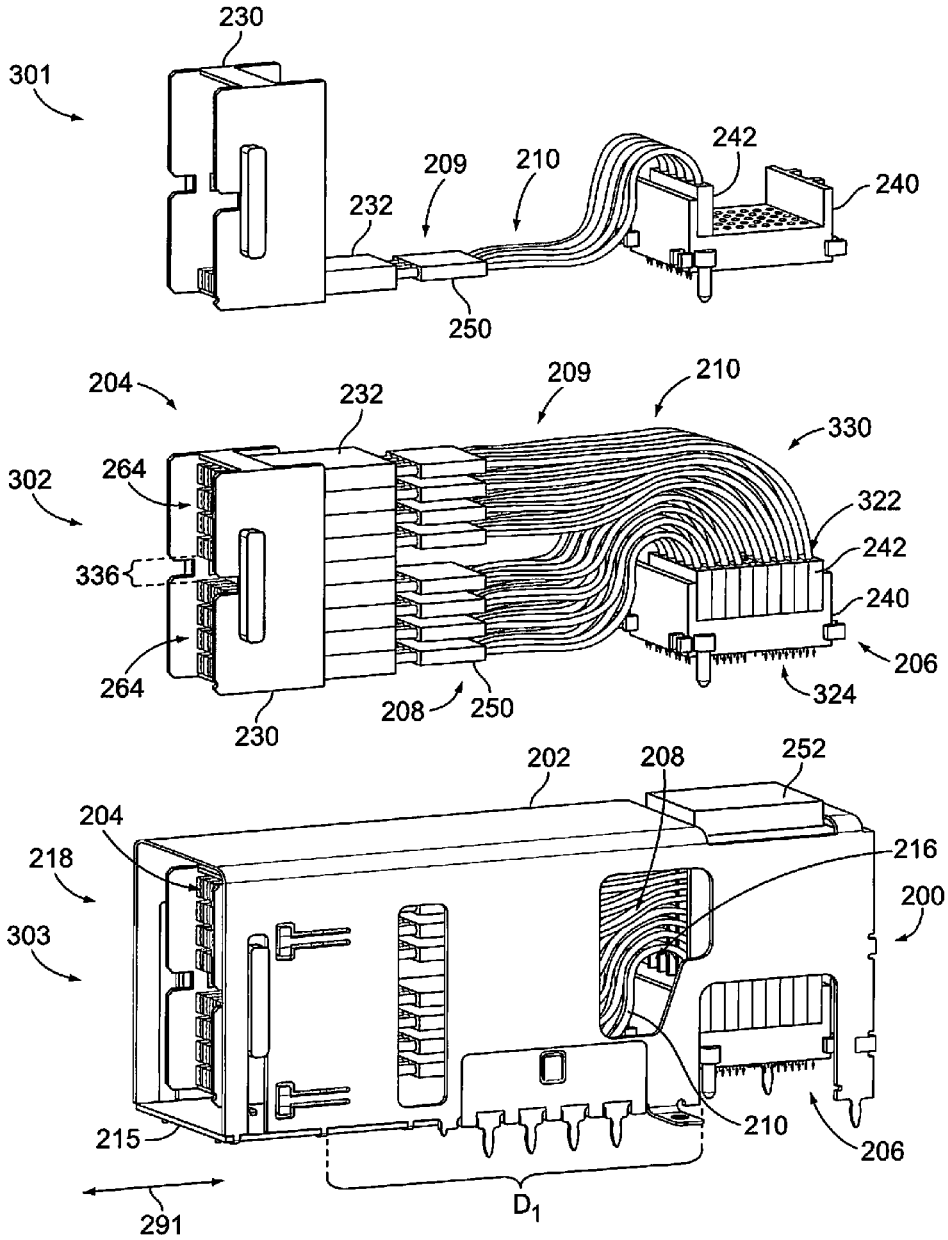
FIG. 5 illustrates the connector assembly of FIG. 3 at different stages of assembly.

In an exemplary embodiment, the connector assembly 200 includes an assembly housing or frame 202, a first communication connector 204, a second communication connector 206, and a flexible cable assembly 208. The second communication connector 206 may also be referred to as a board connector 206 since the communication connector 206 can be configured to be mounted to a circuit board. The assembly housing 202 includes a plurality of housing walls 211-214 that define an interior cavity 216 of the assembly housing 202. The housing walls 211-214 include side walls 211, 212, a top wall 213, and a back wall 214. An additional housing wall 215 (also called the bottom wall 215) is shown in FIG. 5 and may be coupled to the other housing walls 211-214. The assembly housing 202 may at least partially enclose one or more of the communication connector 204, the board connector 206, or the flexible cable assembly 208. In particular embodiments, each one of the communication connector 204, the board connector 206, and the flexible cable assembly 208 are located within the interior cavity 216. However, in other embodiments, at least one of the communication connector 204, the board connector 206, or the flexible cable assembly 208 are not located within the interior cavity 216.

In the illustrated embodiment, the first and second communication connectors 204, 206 are electrical connectors configured to interconnect different components and transmit electrical data signals therebetween. However, other types of communication connectors may be used. For example, either or both of the communication connectors 204, 206 may be configured to interconnect optical components. Alternatively, either or both of the communication connectors 204, 206 may be configured to receive optical signals and transform them to electrical data signals and/or receive electrical data signals and transform them to optical signals. In such embodiments that transmit optical signals, the flexible cable assembly may include communication cables that include optical fibers.

The assembly housing 202 includes a leading end 218 and a back end 220 with the interior cavity 216 extending therebetween. The interior cavity 216 opens to the leading end 218. As shown, the assembly housing 202 has a plurality of openings 221-224. The openings 221-224 include a connector opening 221 at the leading end 218, a member opening 222 along the top wall 213, and side openings 223, 224 along the side wall 212. The side wall 211 also has side openings 223, 224 that can oppose the side openings 223, 224 of the side wall 212. However, the member opening 222 and the side openings 223-224 are optional and the assembly housing 202 may not include the member opening 222 and the side openings 223-224 in other embodiments.

As shown in FIG. 3, the housing walls 211-214 extend longitudinally along the mating axis 291. In some embodiments, the housing walls 211-214 are stamped and formed from a common piece of sheet material (e.g., a conductive material) and the housing wall 215 (shown in FIG. 5) is stamped and formed from a different piece of sheet material. In other embodiments, all of the housing walls 211-215 can be stamped and formed from a common piece of sheet material. Alternatively, the assembly housing 202 may be constructed in another manner. For example, separate walls may be coupled together to form the assembly housing 202. The separate walls may be stamped and formed from sheet metal or manufactured through another process (e.g., molding, die-casting, and the like).

The flexible cable assembly 208 includes a plurality of communication cables 210 that interconnect the communication connector 204 and the board connector 206. The communication connector 204 has a mating face 205 that includes an array of electrical contacts 234. In an exemplary embodiment, the communication connector 204 includes a connector housing or body 230 and a plurality of contact modules 232 held by the connector housing 230. The connector housing 230 may have alignment members 238, 239 along exterior surfaces thereof. Each of the contact modules 232 includes at least one of the electrical contacts 234 and a module body 236 that encloses the electrical contact(s) 234. Each of the contact modules 232 is configured to interconnect the corresponding electrical contacts 234 to conductors or wires of the communication cable 210. As shown in FIG. 3, the contact modules 232 are stacked along the orientation axis 292. In alternative embodiments, the contact modules 232 may be stacked along the orientation axis 293.

The board connector 206 also has a mating face 207 that includes an array of electrical contacts 244. In an exemplary embodiment, the board connector 206 includes a connector housing or body 240 and a plurality of contact modules 242 held by the connector housing 240. The board connector 206 is configured to be mounted to a circuit board 314 (shown in FIG. 8). The electrical contacts 244 are configured to mechanically and electrically engage the circuit board 314 when the board connector 206 is mounted thereon. Each of the contact modules 242 can include at least one of the electrical contacts 244 and a module body 246 that encloses the electrical contact(s) 244. Each of the contact modules 242 is configured to electrically interconnect the corresponding electrical contacts 244 to conductors or wires of the communication cable 210. The contact modules 242 are stacked along the mating axis 291. In alternative embodiments, the contact modules 242 may be stacked along the orientation axis 292 in a similar manner as the contact modules 232.

The mating face 205 of the communication connector 204 faces in a mating direction $M_2$ along the mating axis 291, and the mating face 207 of the board connector 206 faces in a mounting direction $M_3$ along the orientation axis 292. As shown, the mating and mounting directions $M_2$ and $M_3$ are perpendicular to each other. However, in alternative embodiments, the mating and mounting directions $M_2$ and $M_3$ can have other relationships. For example, the mating and mounting directions $M_2$ and $M_3$ may face away from each other. Although the communication and board connectors 204, 206 are shown as including the contact modules 232, 242, other types of communication and board connectors may be used that do not include contact modules.

Also shown in FIG. 3, the flexible cable assembly 208 may include one or more cable organizers 250. The cable organizers 250 are located between the communication and board connectors 204, 206 and are configured to hold a plurality of the cables 210. In some embodiments, each of the cable organizers 250 is associated with a corresponding one of the contact modules 232 such that the cable organizer 250 holds all of the cables 210 that connect to the associated contact module 232. Likewise, each of the cable organizers 250 can be associated with a corresponding one of the contact modules 242 such that the cable organizer 250 holds all of the cables 210 that connect to the associated contact module 242. However, in alternative embodiments, a single cable organizer 250 may hold cables 210 from more than one contact module 232 or contact module 242. As shown in FIG. 3, the cable organizers 250 may be closer to the communication connector 204 than the board connector 206. As will be described in greater detail below, the cable organizers 250 may be configured to rotate or twist the cables 210 so that the cables 210 have a predetermined orientation when exiting the cable organizer 250 to couple to the communication connector 204.

Also shown in FIG. 3, the connector assembly 200 may include a seating member 252 coupled to the board connector 206. As will be described in greater detail below, the seating member 252 may facilitate the construction of the connector assembly 200 and/or protect the cables 210.

Figure 4:
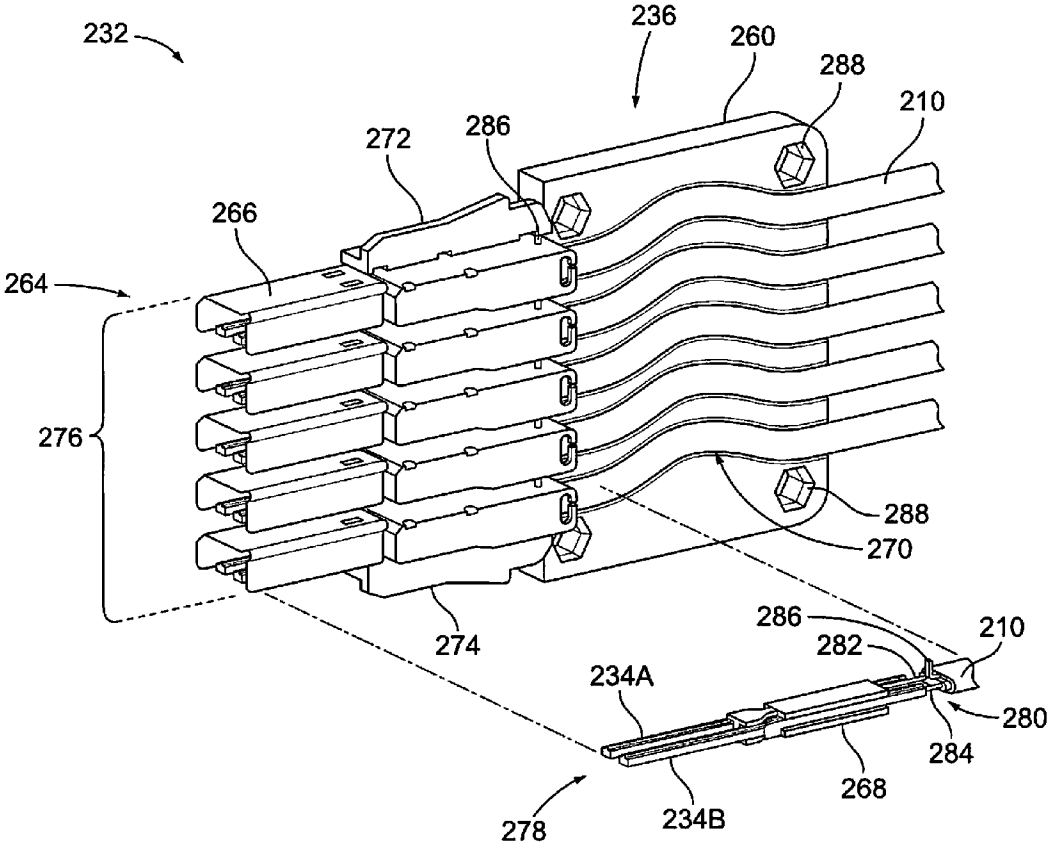
FIG. 4 is an isolated, exposed view of a contact module that may be used with the connector assembly of FIG. 3.

FIG. 4 is an exposed view of one of the contact modules 232. Although the following is with specific reference to the contact modules 232, the description may similarly be applied to the contact modules 242 (FIG. 3). However, the contact modules 232, 242 need not be identical and may have different features and/or dimensions. For instance, the electrical contacts 244 (FIG. 3) may be more suitable for being inserted into vias of the circuit board 314 (shown in FIG. 8).

In an exemplary embodiment, the contact module 232 includes the module body 236 and a plurality of terminal assemblies 264. Each of the terminal assemblies 264 includes a corresponding pair of the electrical contacts 234A, 234B, a dielectric spacer 268, and a ground shield 266. The spacer 268 separates the electrical contacts 234A, 234B of the corresponding terminal assembly 264, and the ground shield 266 surrounds the pair of electrical contacts 234A, 234B and the spacer 268. In an exemplary embodiment, the electrical contacts 234A, 234B are signal contacts that operate as a differential pair.

The module body 236 includes a pair of complementary body shells 260 that are mated together along an interface. Only one body shell 260 is shown in FIG. 1 with the other body shell removed for illustrative purposes. In some embodiments, the body shell 260 is molded from a dielectric material to a predetermined shape. The body shell 260 may also be manufactured by other processes, such as die-casting. As shown, the body shell 260 may include a plurality of channels 270. Each of the channels 270 may be sized and shaped to receive a portion of one cable 210. In some embodiments, the body shell 260 may also be shaped to frictionally engage a portion of each terminal assembly 264. The body shell 260 may also include forward-projecting arms 272, 274 with a terminal-receiving space 276 therebetween. The arms 272, 274 are configured to hold the terminal assemblies 264 therebetween. In the illustrated embodiment, the terminal assemblies 264 may be stacked as a single column.

To assemble the illustrated contact module 232, the cables 210 are inserted into the channels 270 and the terminal assemblies 264 arranged accordingly in the terminal-receiving space 276. The other body shell may then be coupled to the body shell 260 thereby sandwiching the cables 210 therebetween. The pair of body shells 260 may be secured together using an adhesive or fastening device. For example, the body shells 260 include fastener holes 288 that are configured to receive a fastener (not shown) for securing the body shells 260 together.

As shown in FIG. 4, the terminal assemblies 264 may include a mating end 278 and a wire-terminating end 280. The mating end 278 is configured to electrically connect with another terminal assembly (not shown) of a mating connector, such as the connector assembly 120 (FIG. 1). The wire-terminating end 280 is configured to mechanically and electrically connect with the cable 210. For example, the cable 210 may include conductors 282, 284 and a drain wire 286. The conductors 282, 284 may be mechanically and electrically coupled to (e.g., through welding or soldering) the electrical contacts 234A, 234B, respectively. The drain wire 286 may be mechanically and electrically coupled to the ground shield 266. For instance, the drain wire 286 can be bent in a perpendicular manner with respect to the conductors 282, 284 and inserted into a slot (not shown) of the ground shield 266. In an exemplary embodiment, the ground shield 266 includes a pair of complementary parts that are coupled to each other with the electrical contacts 234A, 234B and the spacer 268 therebetween. However, the ground shield 266 may be constructed in other manners.

In alternative embodiments, the module body 236 has channels 270 that curve the cables 210. For instance, the module body 236 can receive the cables 210 extending in a first direction, and the channels can curve the cables 210 to extend in a second direction that is, for example, perpendicular to the first direction before the cables 210 are terminated to the terminal assemblies 264. In this manner, the contact modules 232 (or 242) can be used to form communication connectors that are right-angle-type connectors.

FIG. 5 illustrates the connector assembly 200 at different stages 301-303 of assembly. The fully constructed connector assembly 200 is shown at stage 303. However, the following description is only exemplary and the connector assembly 200 may be constructed in other manners and/or with different components than those illustrated herein. As shown at stages 301 and 302, the connector assembly 200 includes a plurality of cable sub-assemblies 209 that include associated contact modules 232, 242, and a plurality of the cables 210 extending between and joining the associated contact modules 232, 242. Optionally, the cable sub-assemblies 209 may also include the cable organizers 250. The contact modules 232 are inserted into the connector housing 230. Although not shown, the connector housing 230 may include features along inner wall surfaces, such as slots or guide rails, that receive and hold each of the contact modules 232. The contact modules 232 are stacked side-by-side. As shown at stage 302, a module spacing 336 may exist between the terminal assemblies 264 of two adjacent contact modules 232. In a similar manner, the contact modules 242 may be inserted into and held by the connector housing 240.

At stage 302, the communication connector 204 and the board connector 206 are fully constructed. The flexible cable assembly 208 extends between and communicatively couples the board connector 206 and the communication connector 204. As shown at stage 302, the board connector 206 includes a loading side 322 and a mounting side 324 that face in generally opposite directions. The mounting side 324 is configured to be mounted to the circuit board 314 (shown in FIG. 8). In the illustrated embodiment, the loading side 322 includes surfaces of the contact modules 242, but may also include surfaces of the connector housing 240. The cables 210 are coupled to the board connector 206 along the loading side 322. As such, a cable-terminating region 330 exists proximate to the loading side 322 where the cables 210 are located. As will be described in greater detail below, the seating member 252 is positioned in the cable-terminating region 330 and coupled to the loading side 322.

Stage 303 in FIG. 5 illustrates the fully constructed connector assembly 200 according to one embodiment. The assembly housing 202 as shown in FIG. 3 may be mounted to the circuit board 314 over the communication connector 204, the flexible cable assembly 208, and the board connector 206. The bottom wall 215 may then be coupled to the assembly housing 202. As such, the communication connector 204 is disposed in the interior cavity 216 proximate to the leading end 218 of the assembly housing 202. The communication connector 204 may be movably held therein. The board connector 206 is located a distance $D_1$ away from the communication connector 204. The cables 210 extend through the interior cavity 216.

Figure 8:
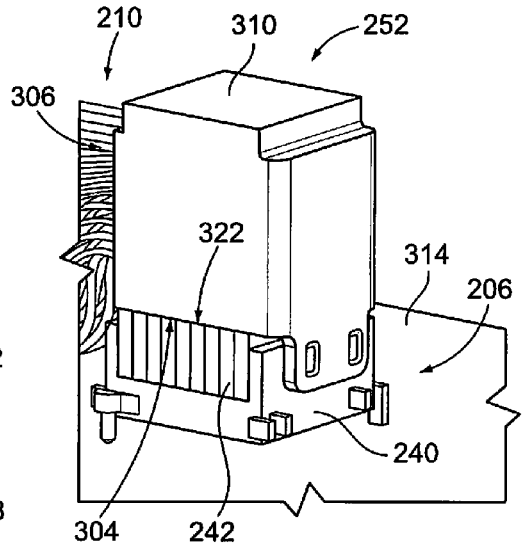
FIG. 8 is a rear perspective view of the seating member coupled to a board connector of the connector assembly of FIG. 3.

When the communication connector 204 and another mating connector (not shown) are mated along the mating axis 291, the communication connector 204 and the flexible cable assembly 208 are permitted to float relative to the assembly housing 202 or the circuit board 314 (FIG. 8). Lengths of the cables 210 can be long enough to couple the communication and board connectors 204, 206 and also long enough to permit the communication connector 204 to float with respect to the assembly housing 202 or the circuit board 314. However, in other embodiments, the distance $D_1$ and the lengths of the cables 210 are even greater. In such cases, the connector assembly 200 may allow transmission of data signals through the cables 210 thereby at least temporarily avoiding conductive pathways along the circuit board 314.

Figure 6:
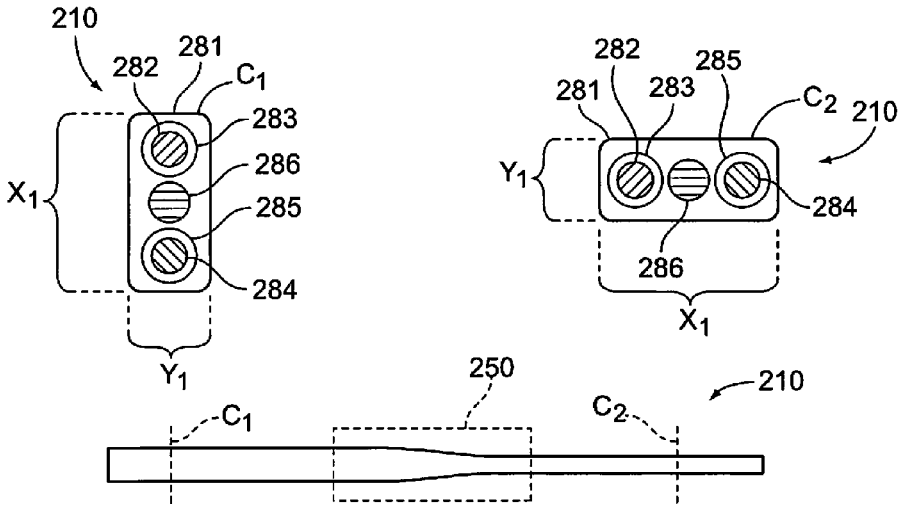
FIG. 6 is a side view of a portion of a communication cable that may be used with the connector assembly of FIG. 3.

FIG. 6 is a side view of a portion of one cable 210 including cross-sections $C_1$ and $C_2$ taken at different positions along a length of the cable 210. The cross-section $C_1$ is taken between the cable organizer 250 (indicated in phantom) and the communication connector 204 (FIG. 3), and the cross section $C_2$ is taken between the cable organizer 250 and the board connector 206 (FIG. 3). As shown, the cable 210 includes the conductors 282, 284 and the drain wire 286. The cable 210 also includes a cable jacket 281 and respective wire jackets 283, 285 for the conductors 282, 284. In an exemplary embodiment, the cable 210 is a twin-axial cable in which the conductors 282, 284 extend parallel to each other and have the drain wire 286 extending therebetween. The illustrated cable 210 may also be referred to as a parallel pair with a center drain. However, other types of communication cables may be used in alternative embodiments. For example, the cable 210 may include a parallel pair of conductors and a drain wire that does not extend between the parallel conductors. The cable 210 may also be a twisted-pair cable in which the conductors are twisted about a center drain wire.

In the illustrated embodiment, the cable organizer 250 holds a plurality of the cables 210, but is independent from other cable organizers and other components of the connector assembly 200 (FIG. 3). As such, the cable organizer 250 may be permitted to float relative to the assembly housing 202 (FIG. 3) when the communication connector 204 also floats relative to the assembly housing 202. The cable organizer 250 may group the plurality of cables 210 together to facilitate in the construction of the connector assembly 200. For example, the cable organizer 250 may hold the cables 210 in predetermined spatial relationships with respect to one another so that the cables 210 can be aligned with and terminated to the terminal assemblies 264 (FIG. 4). In particular embodiments, the cable organizer 250 twists the cables 210 so that the cables 210 exit the cable organizer in a predetermined orientation to couple to the communication connector 204.

By way of example, the cables 210 may have non-circular cross-sections, such as oval-shaped or rectangular-shaped cross-sections. As shown, each of the cross-sections $C_1$, $C_2$ of the cable 210 has first and second dimensions $X_1$, $Y_1$. The first and second dimensions $X_1$, $Y_1$ are measured perpendicular to each other. In the illustrated embodiment, the first dimension $X_1$ is greater than the second dimension $Y_1$. As the cable 210 extends through the cable organizer 250, the cable 210 is twisted approximately 90° about a center of the cross-section. However, the degree of twisting shown in FIG. 6 is only exemplary. In other embodiments, the degree of twisting may be more or less than 90°.

Although not shown, the cable organizer 250 may be constructed from two separate body shells. The body shells may include channel portions that are configured to receive the cables 210. The body shells may then be coupled together along an interface to define cable channels therebetween. The cable channels may be shaped to twist the cables 210 as described above. Alternatively, the cable organizer 250 can be molded around the cables 210 while each of the cables 210 is held in a desired orientation and held in a desired position relative to the other cables 210.

Figure 7:
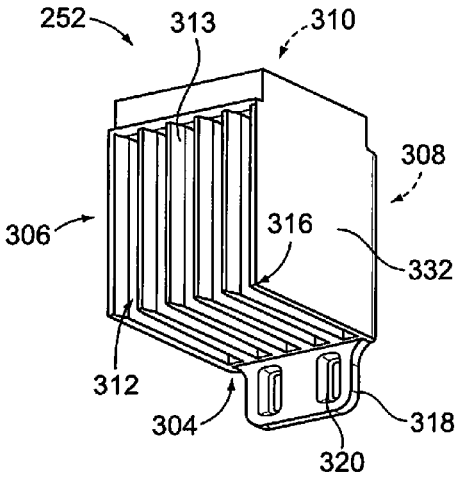
FIG. 7 shows a seating member that may be used with the connector assembly of FIG. 3.

FIG. 7 is a bottom perspective view of the seating member 252. In an exemplary embodiment, the seating member 252 includes a member body 332 that includes a plurality of member sides including a connector side 304, a cable side 306, a back side 308, and a seating side or wall 310. The connector side 304 is configured to interface with the board connector 206 (FIG. 3), and the cable side 306 is configured to receive the cables 210 (FIG. 3). The cable side 306 may also generally face the communication connector 204 (FIG. 3). In the illustrated embodiment, the connector side 304 and the cable side 306 face in different directions that are perpendicular to each other. In alternative embodiments, the connector side 304 and the cable side 306 may face in generally opposite directions.

The seating member 252 also includes a plurality of cable cavities 312 that are accessible through the connector and cable sides 304, 306. In an exemplary embodiment, the cable cavities 312 are rectangular-shaped slots separated by interior walls 313. The cable cavities 312 are configured to receive the cables 210. In an exemplary embodiment, the cable cavities 312 are continuously open between the connector and cables sides 304, 306 at a corner 316 where the connector and cable sides 304, 306 are joined. Also shown in FIG. 7, the seating member 252 also includes a wall extension 318 that extends from the back side 308. The back side 308 may include coupling features 320. The coupling features 320 are shown as holes or openings in FIG. 7, but may be other structural features.

FIG. 8 is a rear perspective view of the seating member 252 coupled to and interfacing with the loading side 322 of the board connector 206. In particular embodiments, a seating member 252 may be used to facilitate mounting the board connector 206 to the circuit board 314 during a mounting operation. By way of example, the seating member 252 may be positioned within the cable-terminating region 330 (FIG. 5) where the cables 210 are grouped together near the board connector 206. Although not shown, the cable-terminating region 330 includes a plurality of spaces that exist between separate rows of cables 210. Each space is capable of receiving one of the interior walls 313 (FIG. 7) of the seating member 252. As such, each of the cable cavities 312 (FIG. 7) is configured to receive a plurality of the cables 210 when the seating member 252 is coupled to the loading side 322 of the board connector 206.

In some embodiments, the seating member 252 may be coupled to the board connector 206 after the cable sub-assemblies 209 (FIG. 5) are constructed. More specifically, the seating member 252 may be coupled to the board connector 206 after the cables 210 are coupled to the contact modules 232 (FIG. 3), 242, and after the contact modules 232, 242 are coupled to the respective connector housings 230 (FIG. 3), 240. Because the cable cavities 312 are continuously open along the connector and cable sides 304, 306 and therebetween, the cables 210 may be received by the cable cavities 312.

In an exemplary embodiment, the cables 210 exit the seating member 252 through the cable side 306 and extend toward a remote location (e.g., the communication connector 204 (FIG. 3)). During the mounting operation of the board connector 206, the seating member 252 is configured to be pressed toward the circuit board 314. More specifically, the seating wall 310 may be pressed by an individual's finger or by a tool to press the seating member 252 into the loading side 322 of the board connector 206 thereby mounting the board connector 206 onto the circuit board 314. During the mounting operation, the seating wall 310 and the interior walls 313 of the seating member 252 protect the cables 210 from being inadvertently bent by the individual's finger or tool. In the illustrated embodiment, the seating member 252 remains in the connector assembly 200 (FIG. 3) after the mounting operation. However, in other embodiments, the seating member 252 may be removed.

Accordingly, the cables 210 can extend through the cable cavities 312 along non-linear paths. For example, the cables 210 may be bent about 90° within the cable cavities 312. However, in other embodiments, the cables 210 may be bent more or less than 90°. In alternative embodiments where the connector and cable sides 304, 306 face in opposite directions, the cables 210 may extend straight through the seating member 252.

Figure 9:
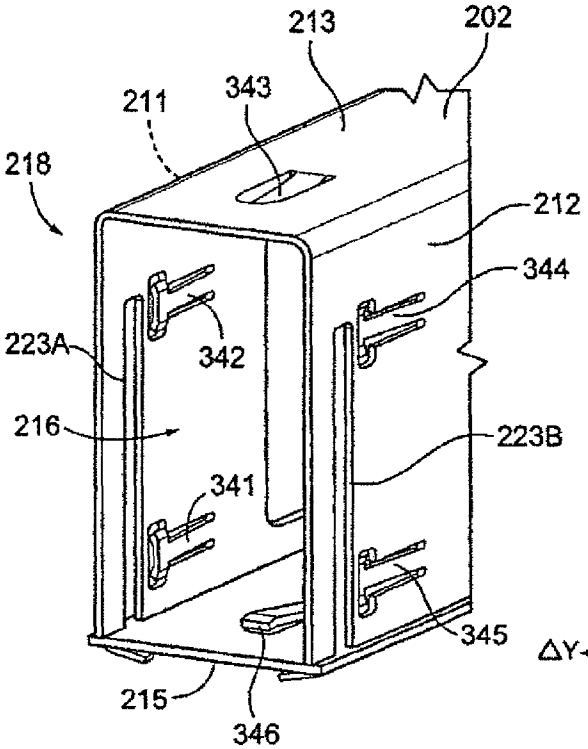
FIG. 9 is an isolated view of a portion of an assembly housing that may be used with the connector assembly of FIG. 3.

FIG. 9 is an isolated view of the leading end 218 of the assembly housing 202 including the housing walls 211-213 and 215. In some embodiments, the assembly housing 202 movably or floatably holds the communication connector 204 (FIG. 3) within the interior cavity 216. For example, the housing walls 211-213 and 215 may include a plurality of biasing members 341-346. In an exemplary embodiment, the biasing members 341-346 are stamped and formed from the respective housing wall. However, in alternative embodiments, the biasing members 341-346 may be other elements that are coupled to the housing walls 211-213, 215.

The biasing members 341-346 are proximate to the leading end 218 and are configured to engage the communication connector 204 within the interior cavity 216. The biasing members 341-346 are pre-disposed or biased in predetermined positions. For example, the biasing members 341-346 extend radially inward from the respective housing walls 211-213 and 215 and are capable of flexing radially outward. Also shown in FIG. 9, the assembly housing 202 includes the side openings 223A, 223B in the respective side walls 211, 212. The side openings 223A, 223B can extend along the orientation axis 292 (FIG. 3). The side openings 223A, 223B are sized and shaped to receive the alignment members 238, 239 (FIG. 3) of the connector housing 230 (FIG. 3). The side openings 223A, 223B and the respective alignment members 238, 239 cooperate with each other to permit movement of the communication connector 204.

Figure 10:
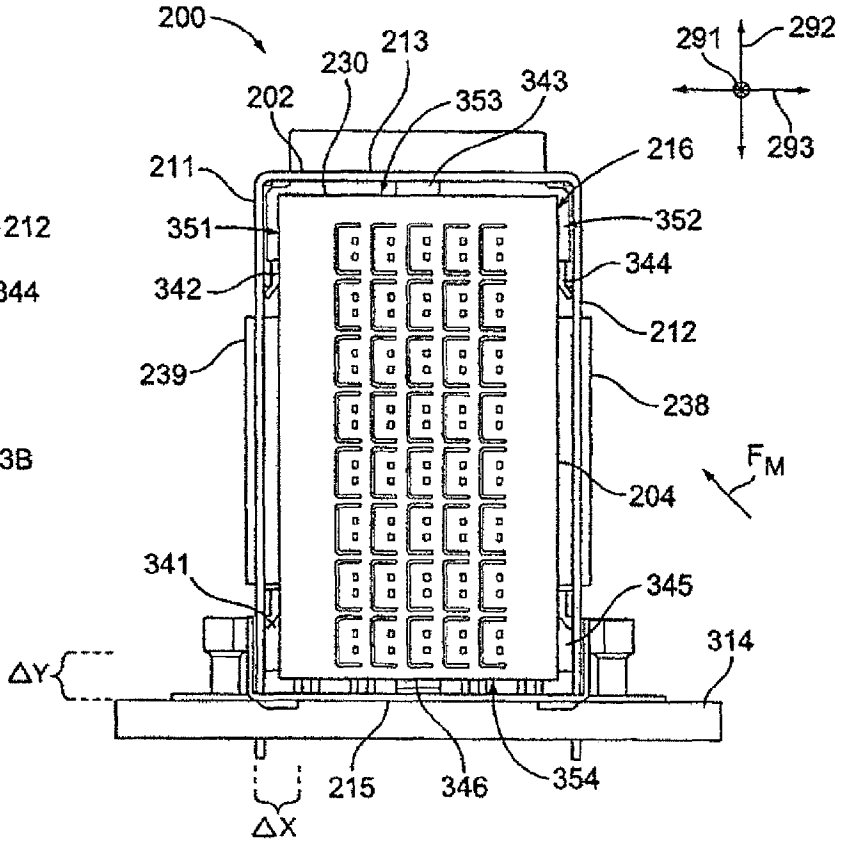
FIG. 10 is an end view of the connector assembly of FIG. 3.

FIG. 10 is an end view of the connector assembly 200 taken along the mating axis 291. In some embodiments, the communication connector 204 is permitted to move in at least one direction that is perpendicular to the mating axis 291. In particular embodiments, the communication connector 204 is permitted to move in any direction along a plane that is transverse to the mating axis 291 (i.e., along a plane that is parallel to the orientation axes 292, 293). In other embodiments, the communication connector 204 may also be capable of moving along the mating axis 291.

The communication connector 204 and the mating connector (not shown) are configured to be mated along the mating axis 291. During the mating operation, the communication connector 204 and the mating connector are moved relatively toward each other. For example, the communication connector 204 may be moved toward the mating connector, the mating connector may be moved toward the communication connector 204, or a combination of movements may occur. If the communication connector 204 and the mating connector initially engage each other in a misaligned manner during the mating operation, the communication connector 204 is permitted to move relative to the assembly housing 202 or the circuit board 314 to align the communication connector 204 and the mating connector for mating.

As shown in FIG. 10, the connector housing 230 includes exterior surfaces 351-354 that are spaced apart from corresponding interior surfaces of the housing walls 211-213, 215. The biasing members 341-346 are configured to hold the communication connector 204 substantially in a center of the interior cavity 216 (FIG. 9) when viewed along the mating axis 291. The biasing members 341-346 may hold the communication connector 204 substantially equi-spaced from the housing walls 211-213, 215. Accordingly, the spaces between the exterior surfaces 351-354 and the housing walls 211-213, 215 allow the connector housing 230 to move a distance Δx along the orientation axis 293 and a distance Δy along the orientation axis 292. Also shown, the alignment members 238, 239 project from the exterior surfaces 352, 351, respectively, and through the side openings 223B, 223A (shown in FIG. 9), respectively.

When the communication connector 204 and the mating connector are initially engaged in a misaligned manner, the misalignment may provide a lateral force $F_M$ in a direction that is transverse to the mating axis 291. Although the arrow indicating the direction of the lateral force $F_M$ is in one particular direction in FIG. 10, the direction of the lateral force $F_M$ can be in any direction that is transverse to the mating axis 291. The lateral force $F_M$ causes the communication connector 204 to press against one or more of the biasing members 341-346, which are then deflected and thereby allow the communication connector 204 to move in the direction of the lateral force $F_M$. Accordingly, the connector assembly 200 may use an alignment mechanism that includes the biasing members 341-346, the alignment members 238, 239, the side openings 223A, 223B, and spaces between the exterior surfaces 351-354 to permit the communication connector 204 to move in the direction of the lateral force $F_M$.

However, the alignment mechanism described above is only exemplary and other alignment mechanisms that allow the communication connector 204 to align with the mating connector may be used. For example, the biasing members 341-346 can be springs that are biased in a predetermined manner. Alternatively, the connector housing 230 may include biasing members that are similar to the biasing members 341-346. The alternative biasing members may press against the interior surfaces of the assembly housing 202.

Figure 11:
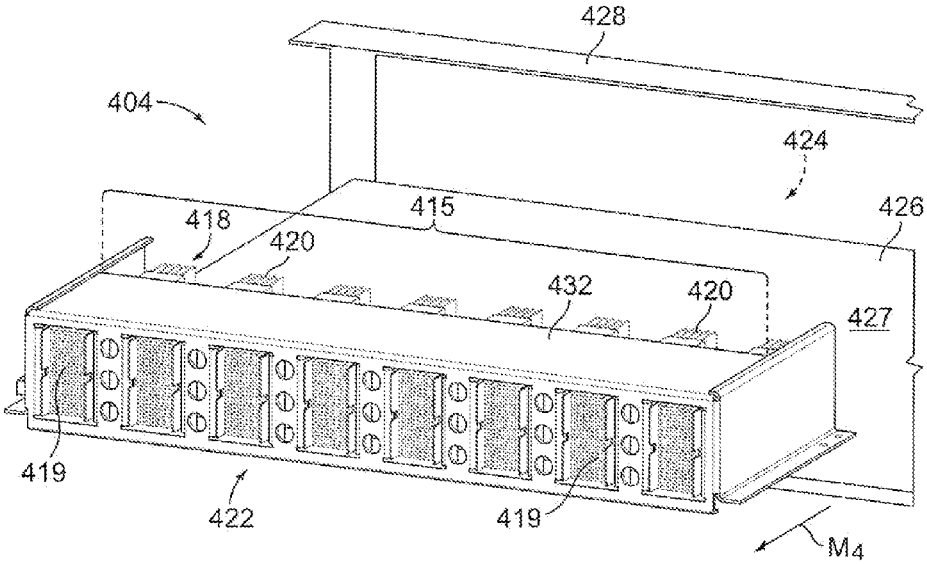
FIG. 11 is a perspective view of a communication device formed in accordance with one embodiment.

FIG. 11 shows a perspective view of a portion of a communication device 404 formed in accordance with one embodiment. The communication device 404 may be similar to the communication device 104 (FIG. 2) and configured to be used in a communication system (not shown) that can be similar to the communication system 100 (FIG. 1). In an exemplary embodiment, the communication device 404 has a leading or mating side 422 and a trailing or rear side 424.

As shown in FIG. 11, the communication device 404 may include a plurality or group 415 of connector assemblies 418, a circuit board 426 having a board surface 427, a module frame 428, and an assembly housing or support structure 432. The connector assemblies 418 are arranged side-by-side and face in a common mating direction $M_4$. In the illustrated embodiment, the connector assemblies 418 are similar to the connector assemblies 200 (FIG. 3). For example, the connector assemblies 418 may include a communication connector 419 and a board connector 420. The communication and board connectors 419, 420 may be communicatively coupled through a flexible cable assembly (not shown). The cable assembly may be similar to the cable assembly 208 (FIG. 3) and include communication cables that extend between and communicatively couple the board connector 420 and the communication connector 419.

In some embodiments, the module frame 428 and the support structure 432 may constitute or be part of a device housing of the communication device 404. As shown, the support structure 432 may be located proximate the leading end 422. The support structure 432 may be configured to at least partially house and/or hold the connector assemblies 418. For example, the support structure 432 may be configured to movably hold the group 415 of the communication connectors 419. In other words, each of the communication connectors 419 in the group 415 may be movably held by the same support structure 432. Although not shown, the communication device 404 may include additional connector assemblies 418 that are not part of the group 415.

Figure 12:
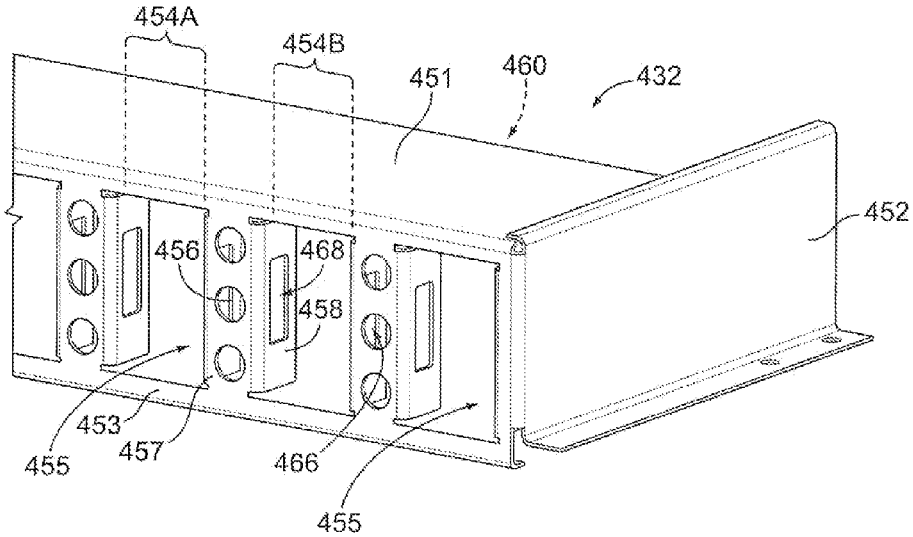
FIG. 12 is a perspective view of a portion of a support structure that may be used with the communication device of FIG. 11.

FIG. 12 is an enlarged view of a portion of the support structure 432. In some embodiments, the support structure 432 is stamped and formed from a common piece of sheet material (e.g., a conductive material). However, the support structure 432 may be constructed from separate parts in other embodiments. As shown in FIG. 12, the support structure 432 may have a plurality of housing walls 451-453 that include a cover wall 451, an exterior wall 452, and a mating frame 453. The mating frame 453 is configured to be located proximate to the leading end 422 (FIG. 11). In the illustrated embodiment, the mating frame 453 includes a plurality of connector openings 454 that provide access to an interior cavity 460 that is located between the cover wall 451 and the circuit board 426.

Adjacent connector openings, such as the connector openings 454A, 454B, may be separated by a corresponding separator 455. In some embodiments, each of the separators 455 includes a plurality of sidewalls 456-458. The sidewalls 456, 458 of one separator 455 are configured to interface with adjacent communication connectors 419 (FIG. 11). The sidewalls 456, 458 include respective side openings 466, 468. The side openings 466, 468 may be similar to the side openings 223 (FIG. 9) and be configured to engage the communication connectors 419 (FIG. 11). The sidewall 457 faces in the mating direction $M_4$ and may have openings to permit airflow.

Returning to FIG. 11, one exemplary method of manufacturing the communication device 404 may include mounting a plurality of the board connectors 420 to the circuit board 426. Each of the board connectors 420 may already be coupled to a corresponding flexible cable assembly (not shown) and a corresponding communication connector 419 or the cable assembly and the communication connector 419 may be coupled after the board connector 420 is mounted to the circuit board 426. The support structure 432 may then be mounted to the circuit board 426 over the communication assemblies 418. When the support structure 432 is mounted thereto, the communication connectors 419 may be received in respective spaces that are defined between adjacent separators 455 (FIG. 12). The sidewalls 456, 458 may be flexed or otherwise manipulated so that the side openings 466, 468 receive alignment members, such as the alignment members 238 (FIG. 10). Accordingly, the communication connectors 419 may be movably held by the same support structure or assembly housing in a similar manner as described above with respect to the communication connector 204 and the assembly housing 202. The communication connectors 419 and the corresponding cable assemblies (not shown) may float with respect to the support structure 432.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a communication connector including an array of electrical contacts having substantially fixed positions with respect to one another;

a board connector configured to be mounted to a circuit board and located a distance away from the communication connector; and a flexible cable assembly comprising communication cables that extend between and communicatively couple the hoard connector and the communication connector, wherein the communication connector is configured to engage a mating connector when the communication connector and the mating connector are mated along a mating axis, the communication connector and the flexible cable assembly being permitted to float relative to the board connector when the communication connector mates with the mating connector, wherein the communication connector is permitted to move along a plane that is transverse to the mating axis as the communication connector mates with the mating connector.

2. The connector assembly of claim 1, further comprising an assembly housing that holds the communication connector and permits the communication connector to move relative to the assembly housing along the plane that is transverse to the mating axis.

3. The connector assembly of claim 1, further comprising an assembly housing having a leading end, a back end, and an interior cavity extending therebetween, the interior cavity opening to the leading end, the communication connector being held proximate to the leading end.

4. The connector assembly of claim 3, wherein the assembly housing includes biasing members that engage the communication connector, the biasing members holding the communication connector in the interior cavity and permitting the communication connector to move relative to the assembly housing.

5. The connector assembly of claim 1, further comprising a plurality of the communication connectors and a plurality of the board connectors, each of the communication connectors of said plurality being communicatively coupled to a corresponding board connector.

6. The connector assembly of claim 1, further comprising a plurality of the communication connectors coupled to corresponding communication cables, wherein said plurality of the communication connectors are movably held by a common support structure.

7. The connector assembly of claim 1, wherein the communication connector is permitted to move in any direction along the plane that is transverse to the mating axis.

8. The connector assembly of claim 1, further comprising a cable organizer that holds a plurality of the cables, the cable organizer being permitted to float relative to the board connector when the communication connector floats relative to the board connector.

9. The connector assembly of claim 1, wherein at least one of the communication or board connectors includes contact modules having electrical contacts, each of the contact modules receiving a plurality of the cables and connecting said cables to the electrical contacts.

10. The connector assembly of claim 1, wherein the communication connector faces along the mating axis when mated to the mating connector, the board connector having a mounting side and an array of electrical contacts disposed therealong, the mounting side configured to be mounted to the circuit board and face in a direction that is perpendicular to the mating axis.

11. The connector assembly of claim 2, wherein at least one of the assembly housing and the communication connector includes biasing members, the biasing members permitting the communication connector to move relative to the assembly housing.

12. A communication device comprising:

a device housing having leading and trailing sides, the device housing including a support structure that is located proximate to the leading side; and a connector assembly held by the device housing, the connector assembly comprising:

a first communication connector movably coupled to the support structure and positioned proximate to the leading side;

a second communication connector located a distance away from the first communication connector in the device housing; and a flexible cable assembly comprising communication cables that extend between and communicatively couple the first and second communication connectors, wherein the first communication connector is configured to engage a mating connector when the first communication connector and the mating connector are mated along a mating axis, the first communication connector and the flexible cable assembly being permitted to float relative to the support structure when the first communication connector mates with the mating connector.

13. The communication device of claim 12, wherein the first communication connector is permitted to float in any direction along a plane that is transverse to the mating axis.

14. The communication device of claim 12, further comprising a cable organizer that holds a plurality of the cables, the cable organizer being permitted to float relative to the support structure when the first communication connector mates with the mating connector.

15. The communication device of claim 14, wherein the cable organizer twists the cables so that the cables exit the cable organizer in a predetermined orientation to couple to the first communication connector.

16. The communication device of claim 12, further comprising a circuit board, the second communication connector being mounted to the circuit board.

17. The communication device of claim 12, further comprising a plurality of said connector assemblies, each of the first communication connectors being movably coupled to the support structure.

* * * * *